US011083279B2

(12) United States Patent
Sanchez Martinez et al.

(10) Patent No.: US 11,083,279 B2
(45) Date of Patent: Aug. 10, 2021

(54) COSMETIC DEVICE WITH EXCHANGEABLE APPLICATION HEAD

(71) Applicant: Braun GmbH, Kronberg (DE)

(72) Inventors: Pedro Sanchez Martinez, Kronberg (DE); Thomas Steiner, Trebur (DE); Lars Gerlach, Schwalbach (DE); Ferdinand Hermann, Koenigstein (DE)

(73) Assignee: Braun GMBH, Kronberg (DE)

( * ) Notice: Subject to any disclaimer, the term of this patent is extended or adjusted under 35 U.S.C. 154(b) by 501 days.

(21) Appl. No.: 15/425,152

(22) Filed: Feb. 6, 2017

(65) Prior Publication Data

US 2017/0238686 A1 Aug. 24, 2017

(30) Foreign Application Priority Data

Feb. 23, 2016 (EP) ..... 16157002

(51) Int. Cl.
*A46B 5/00* (2006.01)
*A46B 9/02* (2006.01)
(Continued)

(52) U.S. Cl.
CPC ..... *A46B 5/0095* (2013.01); *A46B 9/021* (2013.01); *A46B 13/02* (2013.01);
(Continued)

(58) Field of Classification Search
CPC ..... A61H 7/003; A61H 7/002; A61H 21/00; A61H 33/60; A61H 2201/1635;
(Continued)

(56) References Cited

U.S. PATENT DOCUMENTS 7,331,339 B2 * 2/2008 Smith ..... A61J 1/065 128/200.14
8,844,521 B2 * 9/2014 McCarthy ..... A61M 16/06 128/200.24
(Continued)

FOREIGN PATENT DOCUMENTS

CN 201750912 U 2/2011
CN 203168312 U 9/2013
(Continued)

OTHER PUBLICATIONS

European Search Report dated Aug. 18, 2016.
(Continued)

*Primary Examiner* — Justine R Yu
*Assistant Examiner* — Alexander Morales
(74) *Attorney, Agent, or Firm* — Kevin C. Johnson; Stefan Michael Schneider

(57) ABSTRACT

A cosmetic device with an exchangeable application head and a device body, wherein the device body contains a motor and drive mechanism, an actuating switch, a power supply, a head recognition element and a control element adapted to control the motor and drive mechanism based on an actuation of the actuation switch and the application head recognized by the head recognition element. It is provided that the head recognition element comprises at least one mechanical switch disposed on a carrier fixed at the device body. Further, a flexible actuation area is disposed in front of the at least one mechanical switch. The exchangeable application head has at least one recognition generating protrusion actuating through the flexible actuation area on one of the at least one mechanical switches when the exchangeable application head is mounted at the device body.

14 Claims, 4 Drawing Sheets

(51) Int. Cl.
*A46B 13/02* (2006.01)
*A46B 15/00* (2006.01)

(52) U.S. Cl.
CPC ..... *A46B 15/0006* (2013.01); *A46B 15/0014* (2013.01); *A46B 15/0044* (2013.01); *A46B 2200/102* (2013.01); *A46B 2200/1013* (2013.01); *A46B 2200/1026* (2013.01); *A46B 2200/1033* (2013.01); *A46B 2200/1046* (2013.01)

(58) Field of Classification Search
CPC .... A61H 2201/0115; A61H 2201/0107; A61H 2201/0153; A61H 2201/1685; A46B 5/0095; A46B 7/04; H01R 13/641; H01R 13/642; H01R 13/645; H01R 13/6456
USPC ..... 73/767, 763, 806; 116/200; 222/23; 235/435–486, 132 R, 132 E; 340/100, 340/524
See application file for complete search history.

(56) References Cited

U.S. PATENT DOCUMENTS

| | | | | |
|---|---|---|---|---|
| 9,084,587 | B2 * | 7/2015 | Eckhouse | A45D 26/00 |
| 2005/0054957 | A1 * | 3/2005 | Yamazaki | A61H 23/0245 601/46 |
| 2005/0172954 | A1 | 8/2005 | Smith et al. | |
| 2005/0278876 | A1 | 12/2005 | Roth et al. | |
| 2006/0069329 | A1 * | 3/2006 | Nan | A61H 19/34 601/72 |
| 2008/0209650 | A1 | 9/2008 | Brewer et al. | |
| 2014/0142472 | A1 | 5/2014 | Giraud et al. | |
| 2015/0045702 | A1 * | 2/2015 | Lin | A61F 7/007 601/19 |
| 2015/0157119 | A1 * | 6/2015 | Barnes | A46B 15/0044 134/6 |
| 2016/0213558 | A1 * | 7/2016 | Stanbridge | A61H 23/0263 |
| 2017/0036844 | A1 | 2/2017 | Seiders et al. | |

FOREIGN PATENT DOCUMENTS

| | | | |
|---|---|---|---|
| CN | 203828815 | U | 9/2014 |
| CN | 204542785 | U | 8/2015 |
| CN | 108697229 | A | 10/2018 |
| DE | 9006367 | U1 | 10/1990 |
| EP | 3210495 | A1 | 8/2017 |
| JP | 2015535457 | A | 12/2015 |
| JP | 2019511271 | | 4/2019 |
| KR | 1020150086512 | A | 7/2015 |
| KR | 20180111882 | A | 10/2018 |
| WO | 2006002183 | A2 | 1/2006 |
| WO | 2017144992 | A1 | 8/2017 |

OTHER PUBLICATIONS

Office Action dated Aug. 2, 2019; Application No. 201780012874.0; The State Intellectual Property Office of People's Republic of China.
Notice to Grant dated Mar. 3, 2020; Application No. 201780012874.0; The State Intellectual Property Office of People's Republic of China.
Yamamoto, Takeharu; Notice of Reasons for Refusal dated Oct. 29, 2019; Application No. JP 2018544542; Japanese Patent Office.
Yamamoto, Takeharu; Decision to Grant dated Apr. 7, 2020; Application No. JP 2018544542; Japanese Patent Office.
International Search Report and Written Opinion dated Apr. 5, 2017; Application No. PCT/IB2017/050515; European Patent Office.
Notification of Reason for Refusal dated Jan. 17, 2020; Application No. 10-2018-7024904; Korean Intellectual Property Office.
Search Report; Application No. 2017800128740; dated Jul. 25, 2019; The State Intellectual Property Office of People's Republic of China.

* cited by examiner

COSMETIC DEVICE WITH EXCHANGEABLE APPLICATION HEAD

FIELD OF THE INVENTION

The invention relates to a cosmetic device with at least one exchangeable application head. More specifically, the cosmetic device might comprise a plurality of exchangeable application heads, the heads covering one or more functions. The exchangeable application heads might be chosen from any one of the following epilator head, brush head, skin toning head, cooling head or twister head, for example. The functions of the head might comprise mechanical or electrical functions, or any combinations thereof.

BACKGROUND OF THE INVENTION

In the US 2014/0142472 A1 a message device with at least one type of a removable and changeable massage head is disclosed. Massage elements of the head are activated via a drive mechanism contained in the body of the device. The device includes as an example mechanical sensors for a head recognition. These mechanical sensors are actuated by direct contact of protuberances defined in the removable head coming into abutment against the mechanical sensors. Thus, the type of massage head can be recognized. A control box in the device body controls motors and other device components based on the type of massage head installed. However, this massage device is not protected against humidity entering the interface between the device body and the removable head.

SUMMARY OF THE INVENTION

It is accordingly one object of the present invention to provide a cosmetic device with an exchangeable application head suited for dry and wet applications.

This object is solved by cosmetic device according to claim 1 with at least one of preferably several exchangeable application heads and a device body wherein the device body contains a motor and drive mechanism, an actuating switch, a power supply (such as a rechargeable secondary battery), a head recognition element and a control element adapted to control the motor and drive mechanism based on an actuation of the actuation switch and the application head recognized by the head recognition element.

The device body can advantageously be water tightly closed by a device cover, the device cover being for example the interface element between the device body and the exchangeable application head by clipping the application head on the device cover, the device cover comprising a sealed drive coupling for connecting the motor and drive mechanism mechanically and/or electrically to the application head and connection means for fixing the device cover to the device body. The connection means might e.g. be a snap fit comprising a latch for form fitting with the device body. A seal is advantageously disposed between the device body and the device cover, the seal being fixed in the device body and/or the device cover for water tightly closing the device body with the device cover such that any components housed in the device body and/or device cover are protected from humidity and water, e.g. for wet applications of the cosmetic device.

One important aspect of the proposal is defined in claim 1. The head recognition element comprises at least one, preferably several, and in particular 2 or three, mechanical switches disposed on a carrier fixed at the device body. The carrier might be an electric circuit board disposed at the device body such that the mechanical switches are arranged protruding from the device body and covered by the device cover when a device cover is provided and fixed to the device body. A flexible actuation area is disposed in front of the mechanical switches. For example, the device cover might be comprised in a wall of the device cover (of more generally of the device body), preferably in a side wall of the device cover or body.

The flexible actuation area might comprise rigid and soft elements. One rigid element can be provided for each mechanical switch such that upon executing pressure onto the rigid element it is elastically moving towards one mechanical switch and switching on the mechanical switch (in the meaning that only this one mechanical switch is actuated or switched, and that upon releasing the pressure from the rigid element it is elastically moving away from the mechanical switch and switching off the mechanical switch). Further, at least one soft element might be disposed between the wall of the device cover and the rigid elements, thus water tightly closing the side wall of the device cover or body and allowing the elastic movement of the rigid element in the device cover. The at least one of several exchangeable application heads has at least one recognition generating protrusion switching the at least one mechanical switch e.g. by actuating on one of the rigid elements in the flexible actuation area when the exchangeable application head is clipped on the body cover for executing pressure onto the rigid element. In different heads, there can be provided different recognition generating protrusions attributed or assigned to the different mechanical switches such that each different application head has a unique pattern of recognition generating protrusions switching a unique selection of the mechanical switches for identifying the respective application head.

Thus, in line with the proposal, there is provided a head recognition without electric or electromagnetic coupling between the device, e.g. the device body and/or the device cover, and the exchangeable application head. The use of mechanically actuated switches is a more reliable head recognition in particular in wet environments, as the presence of water might influence electric or electronic signals of the components thus leading to a misrecognition of the head. By providing the flexible actuation area water-tightly connected to the wall of the device body, e.g. the wall or side wall of the device cover, the motor and drive mechanism, the control and other in particular electric or electronic components in the device body are safely protected against humidity entering between the exchangeable application head and the device body, in particular the head and the device cover. In order to additionally protect the material of the soft element against mechanical damage when actuating the mechanical switches by repeated engagement of the recognition generating protrusion of the exchangeable application head with the actuation area, its soft (and thus flexible) parts are reinforced according to an advantageous embodiment to the proposal by the rigid elements coming into contact with the recognition generating protrusions of the application head and the mechanical switch.

Further aspects of the proposal are mentioned in the further claims and explained in the following detailed description of example embodiments according to the proposal. It is to be noted that these aspects are explained with reference to certain embodiments of the proposal. These embodiments might realize one or more of the different preferred features of the proposal. The different aspects or features of the proposal with the related advantages and effects as described and/or evident for the one skilled might be combined without departing from the present invention in any useful combination. The one skilled in the art will acknowledge that any combination of the different aspects or features of the following disclosure in the description and/or the drawings is useful for specific aspects of the proposal, even without combination with other aspects or features disclosed together in one embodiment.

DETAILED DESCRIPTION OF THE INVENTION

The invention is disclosed in the following by way of exemplary embodiments realizing different features and aspects of the invention.

Figure 1:
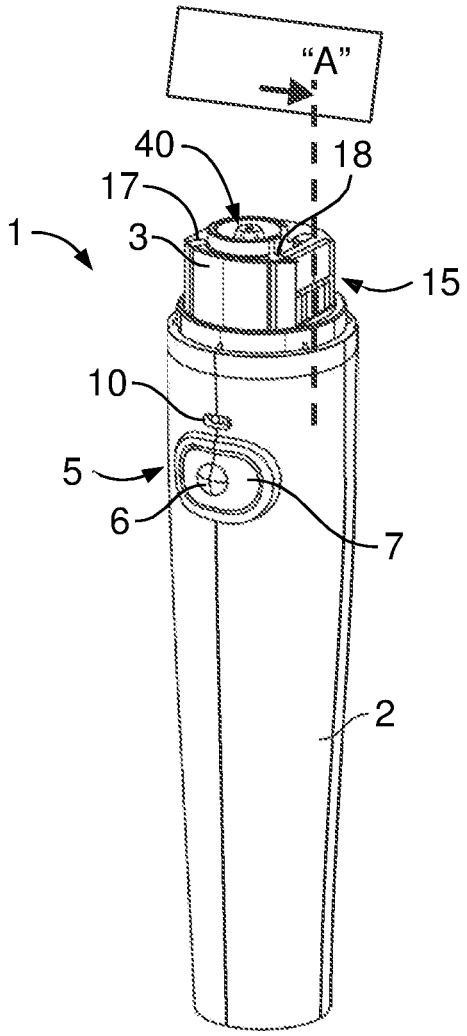
FIG. 1 shows a three-dimensional view of the device body and the device cover of a cosmetic device according to an embodiment of the proposal.

FIG. 1 is an example for a cosmetic device 1 comprising a device body 2 and a device cover 3. The device body 2 covers or contains a motor and drive mechanism 4, a power supply such as a rechargeable battery and a control element not shown in FIG. 1. On the surface of the device body 2, an actuating switch 5 is disposed comprising more than one switching segment for inputting different commands to the element control by the user. Different aspects of the actuating switch according to the proposal are explained later on describing different embodiments according to the proposal with respect to the FIGS. 6 to 10. All these different embodiments can be combined with the present embodiment according to FIG. 1 to FIG. 5B.

In the specific embodiment according to FIG. 1 shown by way of example, the actuating switch 5 comprises two segment covers 6, 7 wherein an inner segment cover 6 is surrounded by the outer segment cover 7. The inner segment cover 6 covers one switching segment, e.g. for switching on and off the device 1. The segment cover 7 is covering two switching segments for switching other functions, such as e.g. left-hand motion or right-hand motion of the motor and drive mechanism or else. The two switching segments related to the segment cover 7 are disposed on one line directed perpendicular to the central axis of the device body next to the segment cover 6, i.e. in FIG. 1 on the left and the right side of the segment cover 6 under a segment cover 7.

Above the actuating switch 5 in FIG. 1, there is provided a LED 10 indicating certain functions of the cosmetic device 1, such as charging, power on, etc.

Figure 2:
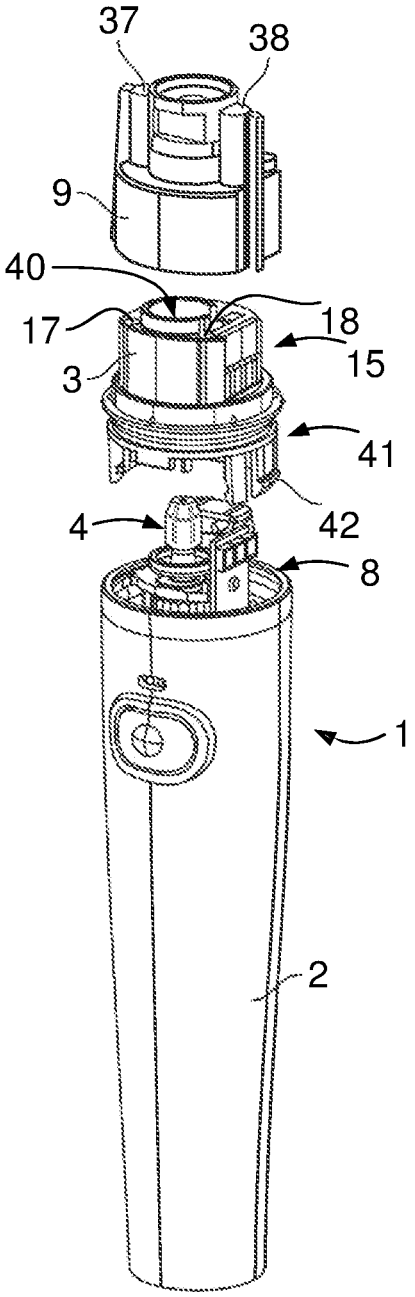
FIG. 2 shows a three-dimensional explosive view of the device body, the device cover and an exchangeable application head.
Figure 3:
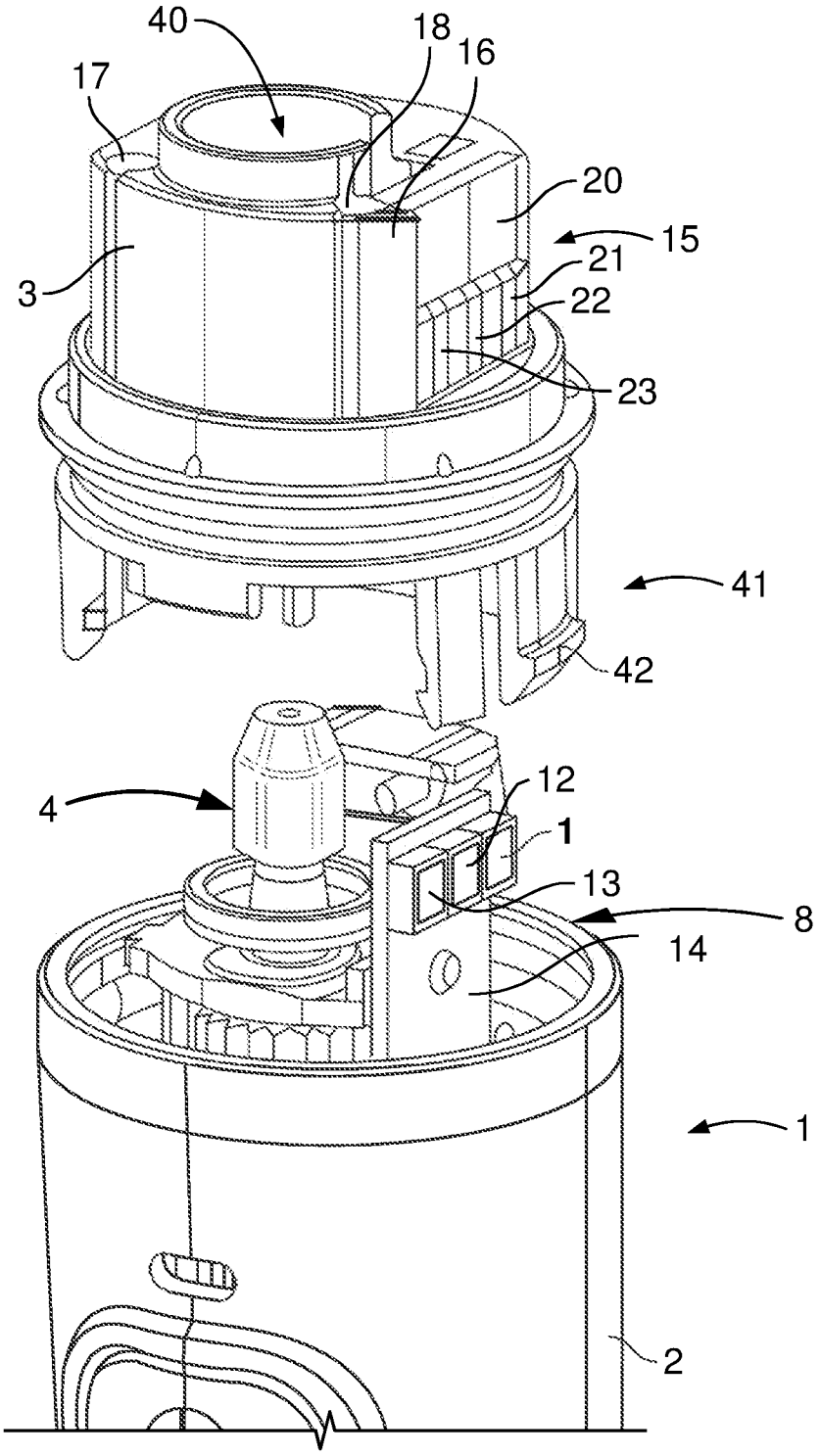
FIG. 3 shows an enlarged view of FIG. 2 with details of the upper end of the device body and the device cover.

The device body 2 further comprises a head recognition element 8 for recognizing an exchangeable application head 9 shown in FIG. 2 that can be clipped on device cover 3. In FIG. 2 only part of the exchangeable application head 9 is shown for demonstration means. The application head might comprise further elements, such as brushes, plates and so on, which are known to the one skilled in the art and need not to be described further in detail here.

Details of the head recognition element 8 and a corresponding flexible actuation area 15 of the device cover 3 are described with respect to FIGS. 3 to 5B in the following by way of an example. Exchangeable application heads 9 might be chosen from any one of the following epilator head, brush head, skin toning head, cooling head or twister head, for example. The functions of the head might comprise mechanical or electrical functions, or any combinations thereof.

The head recognition element 8 comprises several mechanical switches 11, 12, and 13 disposed on a carrier 14 fixed at the device body 2 such that the mechanical switches 11, 12, and 13 are arranged protruding from the device body 2 and covered by the device cover 3 when the device cover 3 is fixed to the device body 2. In the example shown, there are provided three mechanical switches 11, 12, and 13 as an example. However, other embodiments of the proposals might comprise any other number of mechanical switches as required to distinguish different application heads for the cosmetic device. Preferred embodiments might comprise one to three mechanical switches, for example 2 switches in order to distinguish up to three or four different application heads.

According to an advantageous embodiment, the carrier 14 might be a printed circuit board. In the example shown, three mechanical switches 11, 12, and 13 are arranged in one line directed perpendicular to the longitudinal axis (e.g. the center axis) of the device 2 and/or the drive axis of the motor and drive mechanism 4 which might coincidence with each other or might be at least directed in parallel. With respect to this longitudinal or drive axis, the mechanical switches 11, 12, and 13 might preferably be arranged at the outstanding free end of the carrier 14.

With three different mechanical switches 11, 12, and 13 eight different switching states can be realized that might be indicative of eight different exchangeable application heads 9. The number of three mechanical switches 11, 12, and 13 might be a preferred number as eight different application heads might be sufficient for a cosmetic device 1. However, if more or less different exchangeable application heads 9 are provided, the one skilled in the art will vary the number of mechanical switches 11, 12, and 13 according to the number of different exchangeable application heads 9.

The device cover 3 comprises a flexible actuation area 15 in the wall 16 of the device cover 3. In the advantageous example shown, the flexible actuation area 3 is realized in a side wall of the device cover 3. The flexible actuation area 15 is disposed in front of the mechanical switches 11, 12, and 13 when the device cover 3 is fixed to the device body 2. In line with the proposal, the actuation area 15 might optionally have rigid elements 21, 22, and 23 and at least one soft element 20 that is disposed between the three rigid elements 21, 22, and 23 and between the side wall 16 of the device cover 3 and the rigid elements 21, 22, and 23.

In line with the proposal, one rigid element 21, 22, and 23 is provided for each mechanical switch 11, 12 or 13, respectively, such that upon executing pressure onto one or more of the rigid elements 21, 22 and/or 23, they are elastically moving towards one mechanical switch 11, 12 and/or 13, each, thereby switching the respective mechanical switch 11, 12 or 13. This means, that one rigid element 21, 22, and 23 is switching only one mechanical switch 11, 12, or 13, respectively. Upon releasing the pressure from the rigid element 21, 22 and/or 23, it is elastically moving away from the respective mechanical switch 11, 12 and/or 13, and switching off the respective mechanical switch 11, 12, and 13.

The at least one soft element 20 disposed between the rigid elements 21 and 22 as well as the rigid elements 22 and 23 and between the rigid elements 21, 22, and 23 and the side wall 16 (wherein the term "side wall" might include any wall element of the device cover, such as e.g. a top wall) are water-tightly closing the side wall 16 of the device cover 3 allows an elastic movement of each of the rigid elements 11, 12 and/or 13 in the device cover 3, also independently from each other.

Using these (optional) rigid elements 21, 22, and 23 in front of the mechanical switches 11, 12, and 13 the direction and way of the power transmission are precise. This results in a secure switching of the respective mechanical switches 11, 12, and 13 by the application head 9 during use. The rigid elements 21, 22, and 23 might be attached onto the soft element 20 of the flexible actuation area 20, e.g. by gluing, 3-dimensional printing or the like, or be in particular water tightly attached to each other by gluing, clipping or heat sealing or welding to each other.

Figure 4:
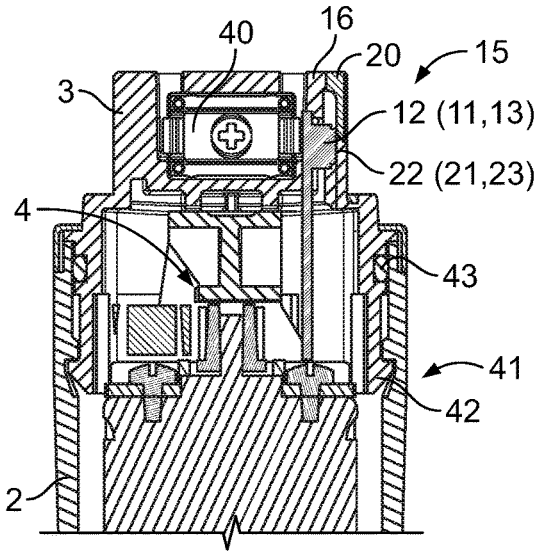
FIG. 4 is a cross sectional view with a cut direction as indicated by the dotted line and the rectangle "A" in FIG. 1 of the device body and the device cover fixed to the device body.

In the cross-sectional view of FIG. 4, the device cover 3 is shown in a state fixed to the device body 2. As evident, the flexible actuation area 15 is disposed in front of the mechanical switches 11, 12, and 13, wherein FIG. 4. shows the mechanical switch 12. In front of the mechanical switches 11, 12, and 13, but without actuating any pressure onto the mechanical switches 11, 12, and 13, there is disposed one rigid element 21, 22, and 23 in front of each of the mechanical switches 11, 12 and 13 (FIG. 4 shows the rigid element 22). The soft element 20 is connecting the side wall 16 of the device cover 3 and all rigid elements 21, 22, and 23.

Figure 5A:
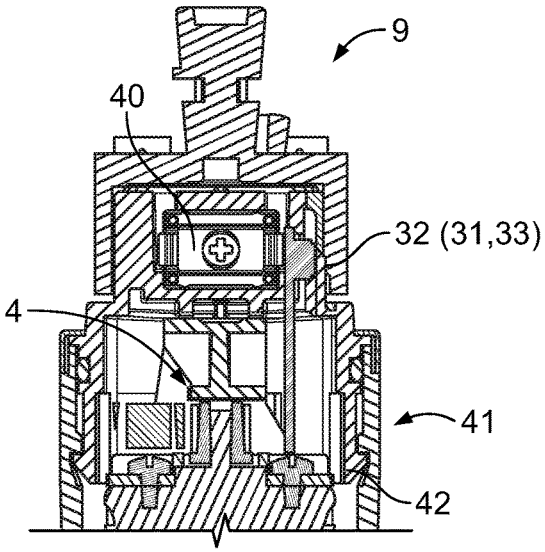
FIG. 5A is a cross sectional view according to FIG. 4 of the device body with the device cover and the exchangeable application head clipped on the device body.

As evident from FIG. 5A, the exchangeable application head 9 comprises at least one recognition generating protrusion 32 (respective recognition generating protrusions 31 and 33 are not shown in the figures) actuating on the rigid elements 22 (in the example shown), 21 and 23 in the flexible actuation area 15 when the exchangeable application head 9 is clipped on the body cover 3. Accordingly, such recognition generating protrusions 31, 32, and 33 (not shown in the FIG. 5A) are used to execute pressure onto the rigid elements 21, 22, and 23, respectively, thereby moving the rigid elements 21, 22, and 23 towards the mechanical switch 11, 12, and 13 and switching the switch into another switching state.

Figure 5B:
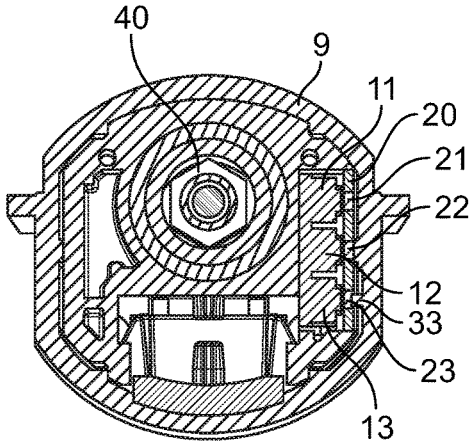
FIG. 5B is a cross sectional view of the device body with the device cover and the exchangeable application head clipped on the device body.
Figure 6:
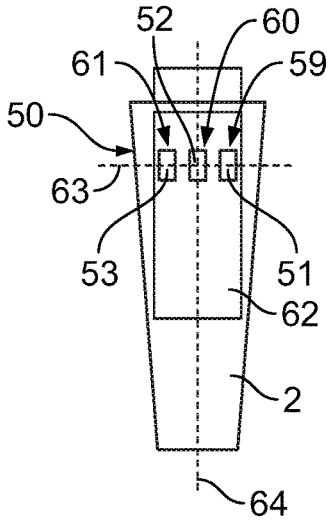
FIG. 6 is a schematic side view of the device body showing with three buttons of the actuation switch representing three switching segments of the actuation switch according to one further aspect of the proposal.

This is evident from FIG. 5B showing one recognition protrusion 33 acting on the rigid element 23 to actuate the mechanical switch 13. In front of the other two mechanical switches 11, and 12, there are arranged rigid elements 21, and 22. However, as there are not provided any recognition generating protrusions 31, and 32 in front of the mechanical switches 11, and 12 and the rigid elements 21, and 22 at this specific application head 9 shown as an example, the mechanical switches 11, and 12 are not actuated together with the mechanical switch 13. Using this switch pattern of actuated and non-actuated switches, the application head can be identified according to the proposal.

As evident from FIG. 1, 4 or 5A, the device body 2 is closed by the device cover 3, the device cover 3 being the interface element between the device body 2 and the exchangeable application head 9 by clipping the application head 9 on the device cover 2. Accordingly, the device cover 3 comprises a sealed drive coupling 40 for connecting the motor and drive mechanism 4 mechanically and/or electrically to the exchangeable application head 9. Further, connection means 41 are provided for fixing the device cover 3 to the device body 2. The connecting means 41 might comprise a latch 42 for form-fitting with the device body 2, as evident from FIGS. 4 and 5A. Thus, the connecting means 41 might be realized in line with an advantageous embodiment of the proposal realize as a snap fit.

For a watertight connection between the device body 2 and the device cover 3, a seal 43 might be disposed between the device body 2 and the device cover 3, the seal 43 being fixed in the device body 2 and/or the device cover 3. In the example shown, the seal 43 is contained in a respective nut of the device cover 3 for coming into engagement with the inner surface of a wall of the device body 2.

Thus, in line with the proposal, there is provided a head recognition without electric or electromagnetic coupling between the device body 2 (plus the device cover 3) and the exchangeable application head 9. The mechanical switches 11, 12, and 13 provided with the head recognition element 8 are nevertheless sealed against humidity by providing the flexible actuation area 15 comprising soft and (optional) rigid elements 20, 21, 22, and 23 for actuating these switches 11, 12, and 13.

The actuation direction of the mechanical switches 11, 12, and 13 might be directed perpendicular to the drive axis or the longitudinal axis of the device body 2. Thus, actuation of the switches 11, 12, and 13 occurs in a direction perpendicular to this axis when the application head 9 is clipped on the device cover 3 in the longitudinal direction of the device body 2. This axis preferably coincidences with the drive axis of the motor and drive mechanism 4, or might be parallel to this drive axis. For this arrangement, the flexible actuation area 15 is disposed according to a preferred embodiment in the sidewall 16 of the device cover 3, as shown in FIG. 2.

The rigid element 21, 22, and 23 is according to an advantageous embodiment in line with the proposal an elastic switching rib integrally formed with device cover 3. The elastic switching rib (i.e. the rigid element 21, 22, and 23) is connected to the device cover 3 in particular at one axial end of the rib. The axial ends are the two rib ends having the biggest distance between each other. The axial end of the rib integrally formed with the side wall 16 of the device cover 3 is preferably directed towards the device body 2 when the device cover 3 is fixed to the device body 2. This allows a maximum of elastic flexibility of the free end of the rib towards inside of the device cover 3.

The at least one soft element 20 of the flexible actuation area 15 is linked water-tightly to the rigid elements and/or the side wall of the device cover by a two-component die casting, welding, gluing or the like.

In line with the proposal, the carrier 14 fixing the mechanical switches is a printed circuit board. The printed circuit board defines a suited carrier 14 which can be mounted in the device body 2 with standard techniques and is suited to support the mechanical switches 11, 12, and 13. Further, the printed circuit board might comprise conductive paths between the mechanical switches 11, 12, and 13 and a connector to a main circuit board with the control elements of the cosmetic device 1. In an alternative embodiment, the control element or part of the control elements of the cosmetic device 1 might also be located on this printed circuit board 14.

One specific embodiment for practically realizing the head recognition with the mechanical switches in line with the proposal, each of the mechanical switches 11, 12, and 13 might be adapted to switch a component which is part of a resistance network (not shown in the figures) such that each switching state of all mechanical switches 11, 12, and 13 together defines a unique voltage level of the resistance network to be detected by a switching state controller, the switching state controller being part of the control element of the cosmetic device 1.

Such a resistance network is a reliable and cost efficient possibility to check the switching position of all of the mechanical switches 11, 12, and 13 by just one voltage and/or current measurement. In case that the mechanical switches 11, 12, and 13 are disposed on a printed circuit board, the resistance network and/or the switching state controller to detect the switching states of all of the mechanical switches 11, 12, and 13 might be disposed on this same printed circuit board 14. Then, the output of this printed circuit board is a head recognition value that can be used by a generic device controller. Both, the switching state controller and the generic device controller build the control element of the cosmetic device 1. Both might be implemented into a processor unit, such as a microprocessor or any other processor device, e.g. an ASIC or other. The switching state controller and the generic device controller might also be implemented into the very same processor unit. Of course, in line with the proposal, the resistance network and/or the switching state controller might be disposed on one or more different circuit boards with respect to the mechanical switches 11, 12, and 13.

In another embodiment according to the proposal, the mechanical switches might be connected directly to ports of a processor unit in a closed circuit for testing the switching state of the mechanical switches by testing e.g. the conductivity or the voltage level of the closed circuit.

The switching state controller might be adapted to test the switching state of the mechanical switches 11, 12, and 13 continuously and/or before and/or during use of the cosmetic device 1, for example in a periodic manner Use of the device 1 might be initiated by switching on the device 1 and initializing the generic device controller. The term "before use" might be understood in this context such that upon switching on the device 1, testing of the state of the mechanical switches 11, 12, and 13 is performed for head recognition. This might be performed by the generic device controller and/or the switching state controller. The term "during use" might be understood such that testing of the state of the mechanical switches 11, 12, and 13 is performed also after switching on and using the device 1, for example in defined periods and/or after stopping one application in order to detect a change of application head 9 performed by the user.

The term "continuously testing the switching state" of the mechanical switch might be understood such that testing is preformed irrespective of the state of the device 1 and in particular in all states when the device is switched on.

All test measurements described before can be performed in a periodic manner, which means that test measurements are repeated after a predefined pause after each measurement. The length of the predefined pause might be fixedly set in the device 1 or parameterisable. For example, the length of the predefined pause might vary dependent on the device status (use, stand-by, type of application or the like).

In case that testing of the state of the mechanical switches 11, 12, and 13 is performed by a switching state controller different from the generic device controller, for example in a processor unit disposed on the circuit board carrying the mechanical switches, the generic device controller might interrogate the recognized application head by usual data communication from the processor housing the switching state controller.

Based on the recognized application head 9, the generic device controller chooses an initialization of the device 1 according to the desired application.

The ways of realizing the head recognition element described before in detail are considered as advantageous embodiments of the proposal. However, the one skilled in the art might realize different approaches for testing the switching states of the mechanical switches for head recognition without leaving the scope of the invention.

In a preferred embodiment, the switching state controller is adapted to detect a change in the switching state of the mechanic switches 11, 12, and 13 upon actuation of at least one of the mechanical switches. In continuation of this aspect of the proposal, the switching state controller might create an interrupt signal readable by the control element, e.g. the generic device controller. This might be used to stop the function of the cosmetic device 1 when e.g. an application head 9 is removed during application. In particular, the motor and drive mechanism 4 and/or any electric supply voltage for electric and/or electronic components comprised in the exchangeable application head 9 might be deactivated if removal of the application head 9 is recognized.

Such a function might be realized by a continuous and uninterrupted (i.e. not periodic) application of a measurement voltage to the mechanical switches 11, 12, and 13 and monitoring a resulting voltage at a measurement point which depends on the state of the mechanical switches 11, 12, and 13. In case of a predefined resistance network, only one measured voltage has to be monitored as one certain value of the detected voltage corresponds to one certain state of all of the mechanical switches 11, 12, and 13. This is also true for periodic measurements.

In order to distinguish different application heads 9, it might be provided according to the proposal that the or preferably each recognition generating protrusion 31, 32, and 33 actuating on one of the rigid elements 21, 22, and 23 in the flexible actuation area 15 is disposed such in the exchangeable application head 9 that the mechanical switch 11, 12, and 13 is actuated by the recognition generating protrusion 31, 32, and 33 in an axial position of the application head 9 relative to the device cover 3 during clipping on the exchangeable application head 9 on the device cover 3 in which axial position the exchangeable application head 9 is not yet engaging the motor or drive mechanism 4. Thus, the head recognition occurs prior to an engagement of the exchangeable application head 9 with the motor and drive mechanism 4, i.e. prior to a mechanical and/or electrical connection of the exchangeable application head 9 to the cosmetic device 1. It is thus possible to control the device functions with respect to the application head 9 based on the head recognition prior to the mechanical and/or electrical connection of head 9 and device 1. Accordingly, the generic device control (as part of the control element of the cosmetic device 1) or the control element can choose a mechanic and/or electric state suited for the application head 9 prior to the connection. Accordingly, a fast start of the function of the cosmetic device 1 is possible due to presetting the coupling (i.e. the motor and drive mechanism 4). This allows a very quick start of use after installation of the head 9 on the device 1 or device cover 3.

In an alternative solution, the respective control might deactivate all mechanic and/or electric functions of the device until the recognition of the application head 9 has been performed after clipping on the head 9 on the device 1 or device cover 3. In this case, however, there might be a notable delay in starting the application after installing the application head 9 which might be sensed negatively by the user.

In line with the proposal, generic device controller can be adapted to initialize device functions depending on the exchangeable head 9 recognized by the head recognition element 8, the generic device controller being part of the control element of the cosmetic device 1. Initializing device functions comprises both, triggering the execution of functional commands executed by the generic device controller and/or initializing certain functions to be executed upon receiving any other command, e.g. by the user, a sensor or a processor of the device 1 when executing a certain software.

According to another aspect of the proposal, the motor and drive mechanism 4 can comprise at least one connector 17 or 18, in most cases at least two connectors 17 and 18, for an electrical connection with at least one counter-connector 37 or 38, in most cases at least two counter-connectors 37 and 38, in the exchangeable application head 9. The generic device controller might accordingly be adapted to supply any voltage and/or current to the at least one connector 17 or 18 only if an exchangeable application head 9 is recognized by the head recognition element 8.

In an advantageous embodiment, at least two connectors 17 are 18 are provided, one of the connectors 17 or 18 being connected to ground and the other connector 18 or 17 being switchable to a supply voltage for feeding the supply voltage to the exchangeable application head 9 after clipping the application head 9 on the device cover 3. By supplying the voltage to a contact 17 or 18 only after recognition of an exchangeable application head 9 with electric functions and/or loads, the contacts 17 or 18 are protected against corrosion in a humid environment as long as no application head 9 with electrical functions is provided with the cosmetic device 1.

Electrical functions of the exchangeable application head 9 might be any functions that require electric energy in the application head 9. The functions might comprise lightening, heating, cooling, storage of energy or the like. Accordingly, an exchangeable application head of the cosmetic according to the proposal might comprise a lightening device, such as a LED or LED-array, a heating and/or cooling element, such as a peltier-element, an energy storing element, such as a secondary battery or capacitor, or the like.

The contacts 17 and 18 and the counter-contacts 37 and 38 might be formed as usual charging pins. Such charging pins are generally used for charging secondary batteries in devices by positioning the device in a charging cradle, for example.

According to another aspect of the proposal, the generic device controller might be adapted to assign certain functions to the actuating switch 5 comprising any one or more of the functions:

- switching off/on
- warming
- cooling
- directing of movement comprising, e.g. left/right, of a mechanical movement
- selecting speed of movement, e.g. low speed, high speed.

Preferably, different of these functions or further functions might be assigned to the actuating switch 5 dependent of the exchangeable application head 9 recognized by the described head recognition element 8. Accordingly, the functions assigned or attributed to the actuating switch 5 can comprise mechanic and/or electric functions.

In an advantageous cosmetic device 1 according to this proposal, the actuating switch 50 comprises at least three, and in particular exactly three, switching segments 59, 60, and 61 wherein each of the switching segments 59, 60, and 61 comprises one button 51, 52, and 53 to be actuated independently from each other. This concept is explained with respect to FIG. 6. These buttons 51, 52, and 53 might be comprised on a printed circuit board 62 and connected with the control element, e.g. the general device control, such that the respective controller detects the switching of each of the buttons 51, 52, 53 by the user. Actuating the buttons 51, 52, and 53 means that only one button 51, 52, and 53 at a time might be actuated or that any combination of two (or more) buttons 51, 52, and 53 might be actuated together at a time or that all (preferably three) buttons 51, 52, and 53 might be actuated together. The buttons might be realized as electronic buttons 51, 52, and 53.

By actuation of more than one button 51, 52, and 53 at a time together, functions such as protection against unwanted activation of the device 1 (child and/or travel protection), menu functions for parameterization of the device 1, reset of the device or the like, might be activated.

In line with the proposal each of the buttons 51, 52, and 53 and each combinations of buttons 51, 52, and 53 might be assigned to any of the different functions of the device 1 as described before. The functions assigned to the buttons 51, 52, and 53, or of combinations of buttons 51, 52, and 53, depend (at least partly) on the exchangeable application head 9 recognized by the head recognition element 8. This is an advantageous embodiment according to the proposal. The assignment of the functions is performed by the control element, e.g. the general device controller of the control element of the device 1. The control element is adapted to assign the functions to the buttons 51, 52, and 53.

In line with the proposal, the three buttons 51, 52, and 53 of the three switching segments 59, 60, and 61 of the actuating switch 50 are arranged in one straight line 63 on the outer surface of the device body 2, wherein the line 63 of the three buttons 51, 52, and 53 is contained in a plane perpendicular to the longitudinal axis 64 of the device body 2 or device 1. The longitudinal axis 64 shown in FIG. 6 corresponds to the longitudinal axis mentioned with respect to the embodiments shown in FIGS. 1 to 5. However, in these figures the longitudinal axis is not drawn for clarity reasons. The longitudinal axis 64 of the device 1 or device body 2 extends from the end of the device body 2 connecting the device cover 3 to the end opposite of the device cover 3. This longitudinal axis 64 might also coincidence with a drive axis of the motor and drive mechanism 4.

By defining the buttons 51, 52, and 53 in the one line 64 on the surface of the device body 2 perpendicular to the longitudinal axis 64 (and/or the drive axis), or more precisely one line 64 lying in a plane perpendicular to this axis 64, the three buttons 51, 52, and 53 can be actuated by a single thumb of the user's hand if the hand of the user holds the device body 2.

In particular, the device body 2 can have a cylinder-like form around the longitudinal axis 64 as a symmetry axis whereas the diameter of the device body 2 might vary along the longitudinal axis 64. Further, the device body 2 might have some deformations with respect to the mathematically ideal form of a cylinder. All these forms are defined as "cylinder-like form" in this text, even if they might appear nearly as quadratic or cuboid form. According to this aspect of the proposal, one-hand-operation is possible for, in particular, compact and slim cosmetic devices 1 extending along a longitudinal axis 64. Slim means that the radial extension of the device 1 is less than about 10 times or more of the axial extension of the device 1 or device body 2. The radial extension shall cover in particular a diameter range from about 1.5 cm to about 5 cm, and in particular between 2.5 and 3 cm.

Figure 7:
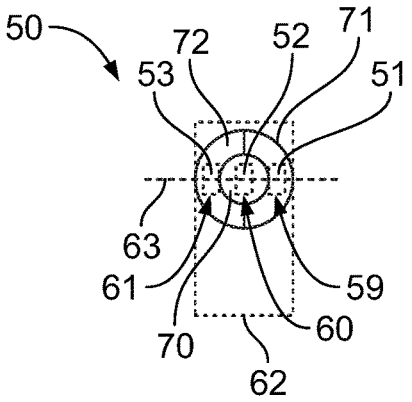
FIG. 7 is a schematic side view of the actuation switch with three cover segments each covering one button and switching segment according to one embodiment of the proposal.
Figure 8:
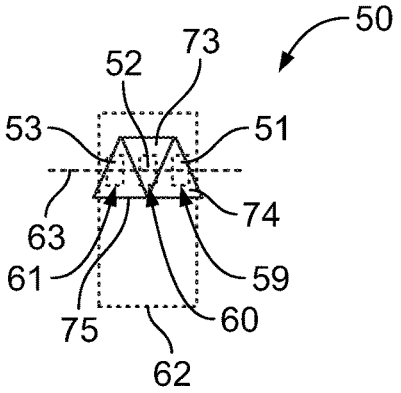
FIG. 8 is a schematic side view of the actuation switch with three cover segments each covering one button and switching segment according to another embodiment of the proposal.
Figure 9:
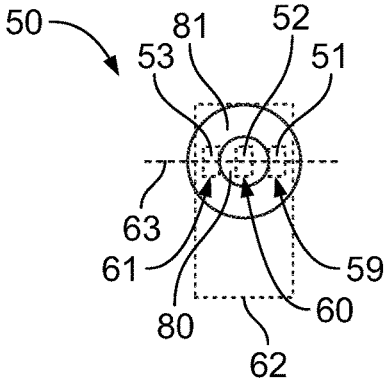
FIG. 9 is a schematic side view of the actuation switch with two cover segments, one cover segment covering one button and one switching segment and the other cover segment covering the other cover segment covering two buttons and two switching elements, according to another embodiment of the proposal.

In line with the proposal, the preferably three switching segments 59, 60, and 61 are water tightly covered by one, two or three cover segments, as shown in the FIGS. 7 to 9.

In FIGS. 7 and 8 embodiments in line with the proposal are shown, in which three cover segments (70, 71, 72; 73, 74, 75) are provided, wherein one cover segment (70, 71, 72; 73, 74, 75) covers one switching segment (60, 59, 61) or button (52, 51, 53), respectively.

According to FIG. 7, one central cover segment 70 covers one switching segment 60 or button 52 of the actuating switch 50. Two lateral cover segments 71 and 72 cover one switching segment 59, 61 or button 51, 53 each. The two lateral cover segments 71 and 72 surround the central cover segment 70 contacting each other along connection line directed in parallel to the longitudinal axis 64 of the device body 2.

In FIG. 8 according to another embodiment, the segment covers 73, 74, and 75 have a triangular form. The tip of the central cover segment 73 is directed to the end of the device body 2 opposed to the device cover 3, and the central cover segment 73 covers the switching segment 60 or button 52 of the actuating switch 50. Two lateral cover segments 74 and 75 cover one switching segment 59, 61 or button 51, 53 each. The two lateral cover segments 74 and 75 show an opposite tip direction with the tip directed towards the device cover 3 such that two sides of the cover segments 73 and 74 and two sides of the cover segments 75 and 73 are aligned with each other.

FIG. 9 shows another embodiment according to the proposal with two cover segments 80 and 81 of the actuating switch 50, one central cover segment 80 covering the central switching segment 60 or button 52 and the other cover segment 81 surrounding the central cover segment 80 covering the two lateral switching segments 59 and 61 or buttons 51 and 53. Advantageously, the central cover segment 80 is in form of a circle, and the other cover segment 81 is in form of an annulus surrounding the circle of the central cover segment 80.

Figure 10:
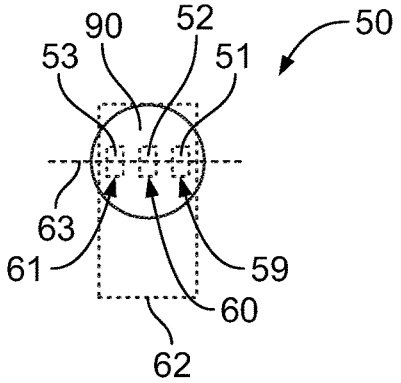
FIG. 10 is a schematic side view of the actuation switch with one cover segment covering all three buttons and all three switching segments according to one embodiment another embodiment of the proposal.

According to a further embodiment in line with the proposal, FIG. 10 show one cover segment 90, wherein the one cover segment 90 covers all three switching segments 59, 60, and 61 or buttons 51, 52, and 53. The one cover segment 90 be in form of circle or any other form covering all buttons 51, 52, and 53.

Generally, in the case of two cover segments 80 and 81, the central button 52 of the switching segment 60 disposed in the line 63 is preferably covered by one cover segment 80, and the two lateral buttons 51 and 53 of the switching segments 59 and 61 are covered by the other cover segment 81.

All cover segments 70, 71, 72; 73, 74, 75; 80, 81; 90 are advantageous made of elastic material that water tightly covers the respective switching segments 51, 52, and 53 and allows an actuation of each of the three buttons 51, 52, and 53 independently from each other.

According to the proposal, the central switching segment 60 might be assigned to the switching on/off function of the device and the lateral switching segments 59 and 61 might be assigned to different directions of movement, different speeds (or lowering and enhancing speed, respectively, i.e. decelerating or accelerating the movement) or different temperatures (or lowering and enhancing temperature, respectively, i.e. warming or cooling).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cosmetic device comprising: an exchangeable application head and a device body, wherein the device body contains a motor and driver, an actuating switch, a power supply, and a head recognition element;

wherein the head recognition element comprises at least one mechanical switch disposed on a carrier fixed at the device body;

a flexible actuation structure comprising at least one actuation element, wherein the flexible actuation structure is disposed in front of the at least one mechanical switch;

the exchangeable application head has at least one recognition generating protrusion actuating through the flexible actuation structure on one of the at least one mechanical switch when the exchangeable application head is mounted at the device body.

2. The cosmetic device according to claim 1, wherein an actuation direction of the at least one mechanical switch is directed perpendicular to a drive axis of the motor and driver or a longitudinal axis of the device body.

3. The cosmetic device according to claim 1, wherein the at least one mechanical switch comprises a plurality of mechanical switches, each of the plurality of mechanical switches is adapted to switch a component which is part of a resistance network such that a switching state of each of the plurality of mechanical switches together defines a unique voltage level of the resistance network to be detected by a switching state controller, wherein the switching state controller advantageously is adapted to detect a change in the switching state of the plurality of mechanical switches upon actuation of the plurality of mechanical switches.

4. The cosmetic device according to claim 1, wherein the at least one mechanical switch comprises a plurality of mechanical switches, wherein the at least one actuation element comprises a plurality of rigid elements, wherein one rigid element of the plurality of rigid elements is, wherein one rigid element is provided for each mechanical switch such that upon executing pressure onto the one rigid element, the one rigid element elastically moves towards the mechanical switch and switches on the mechanical switch and that upon releasing the pressure from the one rigid element, the one rigid element elastically moves away from the mechanical switch and switches off the mechanical switch, wherein the recognition generating protrusion is actuating on at least one of the rigid elements of the plurality of rigid elements when the exchangeable application head is clipped on the body cover by executing pressure onto the rigid element.

5. The cosmetic device according to claim 4, wherein each of the rigid elements of the plurality of rigid elements is an elastic switching rib integrally formed with a device cover.

6. The cosmetic device according to claim 4, wherein the recognition generating protrusion actuating on one of the rigid elements of the plurality of rigid elements is disposed in the exchangeable application head so that the mechanical switch is actuated by the recognition generating protrusion in an axial position of the application head relative to a device cover during clipping on the exchangeable application head on the device cover in which axial position the exchangeable application head is not yet engaging the motor and driver.

7. The cosmetic device according to claim 1, wherein the device body is closed by a device cover, the device cover being an interface element between the device body and the exchangeable application head by clipping the application head on the device cover, the device cover comprising:

a sealed drive coupling for connecting the motor and driver mechanically and electrically to the application head;

and a connecting means for fixing the device cover to the device body;

wherein advantageously a seal is disposed between the device body and the device cover, the seal being fixed in the device body and the device cover.

8. The cosmetic device according to claim 1, wherein a generic device controller is adapted to initialize device functions depending on the exchangeable application head recognized by the head recognition element.

9. The cosmetic device according to claim 8, wherein the motor and driver comprises at least one connector for an electrical connection with at least one counter-connector in the exchangeable application head and that the generic device controller is adapted to supply voltage and current to the at least one connector only if an exchangeable application head is recognized by the head recognition element.

10. The cosmetic device according to claim 8, wherein the generic device controller is adapted to assign certain functions to the actuating switch comprising at least one of:

switching off/on, warming, cooling, directing of movement, or selecting speed of movement.

11. The cosmetic device according to claim 1, wherein the actuating switch comprises at least three switching segments wherein each of the switching segments comprises one button to be actuated independently from each other.

12. The cosmetic device according to claim 11, wherein the button of each of the three switching segments of the actuating switch are arranged in one line on the outer surface of the device body, wherein the line of the three buttons is contained in a plane perpendicular to a longitudinal axis of the device body.

13. The cosmetic device according to claim 11, wherein the three switching segments are water tightly covered by one, two or three cover segments, wherein with three cover segments, one cover segment covers one of the switching segments or buttons, respectively, with two cover segments, one cover segment covers one of the switching segments or buttons and the other cover segment covers two of the switching segments or buttons, with one cover segment, the cover segment covers all three of the switching segments or buttons.

14. A cosmetic device comprising: an exchangeable application head and a device body, wherein the device body contains a motor and driver, an actuating switch, a power supply, and a head recognition element;

wherein the head recognition element comprises at least one mechanical switch disposed on a carrier fixed at the device body;

a flexible actuation area is disposed in front of the at least one mechanical switch, the flexible actuation area has at least one rigid element, wherein the at least one rigid element is provided for the at least one mechanical switch such that upon executing pressure onto the at least one rigid element, the at least one rigid element elastically moves towards the at least one mechanical switch and switches on the at least one mechanical switch and that upon releasing the pressure from the at least one rigid element, the at least one rigid element elastically moves away from the at least one mechanical switch and switches off the at least one mechanical switch;

the exchangeable application head has at least one recognition generating protrusion actuating through the flexible actuation area on one of the at least one mechanical switch when the exchangeable application head is mounted at the device body, wherein the recognition generating protrusion is actuating on the at least one rigid element in the flexible actuation area when the exchangeable application head is clipped on the body cover by executing pressure onto the at least one rigid element, wherein the flexible actuation area has at least one soft element, wherein the at least one soft element is disposed between a wall of the device and the at least one rigid element and is connected water-tightly to the at least one rigid element and the wall of the device.

* * * * *